US009248554B2

(12) United States Patent
Cheng

(10) Patent No.: US 9,248,554 B2
(45) Date of Patent: Feb. 2, 2016

(54) ADJUSTABLE WRENCH

(71) Applicant: Hsin-Tung Cheng, Taichung (TW)

(72) Inventor: Hsin-Tung Cheng, Taichung (TW)

( * ) Notice: Subject to any disclaimer, the term of this patent is extended or adjusted under 35 U.S.C. 154(b) by 251 days.

(21) Appl. No.: 14/020,759

(22) Filed: Sep. 6, 2013

(65) Prior Publication Data

US 2014/0076112 A1 Mar. 20, 2014

(30) Foreign Application Priority Data

Sep. 14, 2012 (TW) ..... 101133641 A

(51) Int. Cl.
*B25B 13/28* (2006.01)
*B25B 13/50* (2006.01)

(52) U.S. Cl.
CPC ..... *B25B 13/28* (2013.01); *B25B 13/505* (2013.01)

(58) Field of Classification Search
CPC ..... B25B 13/10; B25B 13/28; B25B 13/32; B25B 13/505
USPC ..... 81/111, 99, 117
See application file for complete search history.

(56) References Cited

U.S. PATENT DOCUMENTS

| | | | | |
|---|---|---|---|---|
| 676,318 | A * | 6/1901 | Jackson | 81/99 |
| 831,750 | A * | 9/1906 | Smith | 81/99 |
| 937,959 | A * | 10/1909 | Richards | 81/99 |
| 4,616,534 | A * | 10/1986 | Park et al. | 81/99 |
| 6,349,621 | B1 | 2/2002 | Khachatoorain | |

* cited by examiner

*Primary Examiner* — Hadi Shakeri
(74) *Attorney, Agent, or Firm* — Cheng-Ju Chiang

(57) ABSTRACT

The present invention relates to an adjustable wrench. The adjustable wrench comprises a handle part, a curved jaw part, a linkage part, an adjusting element and a restoring element. The handle part comprises a toothed portion. The curved jaw part is pivotally connected to the handle part. When the adjusting element is pushed by an external force, the adjusting element further moves the linkage part simultaneously, and the linkage part pulls the curved jaw part to rotate so as to adjust a size of an opening between the curved jaw part and the toothed portion. Accordingly, the present invention has advantages and effects of fast and simple adjustment for use and a lever arm thereof being adjustable for labor saving, etc.

4 Claims, 8 Drawing Sheets

ADJUSTABLE WRENCH

TECHNICAL FIELD

The present invention relates to an adjustable wrench, and particularly to an adjustable wrench with an adjusting element. The adjustable wrench has advantages and effects of adjusting quickly and easily for use and a lever arm thereof being adjustable for labor saving, etc.

DESCRIPTION OF BACKGROUND

As shown in FIG. 9, a conventional wrench 90 comprises a handle 91, a toothed portion 92, a curved jaw 93, a connecting rod 94 and a change-over switch 95. The handle 91 comprises a trough 911. The trough 911 forms a first slot 911A and a second slot 911B therein. The toothed portion 92 is formed at an end of the handle 91. The curved jaw 93 is pivotally connected to the handle 91. One end of the connecting rod 94 is pivotally connected to the curved jaw 93 while the other end of the connecting rod 94 is pivotally connected to the change-over switch 95. The change-over switch 95 comprises a positioning pin 951. In this manner, when the change-over switch 95 is pushed and the positioning pin 951 is correspondingly located in either the first slot 911A or a second slot 911B, the connecting rod 94 is moved simultaneously to pull the curved jaw 93 pivoting so as to adjust a size of an opening between the curved jaw 93 and the toothed portion 92 for fitting with nuts of different sizes.

However, based on such adjusting design, there are only two adjustable sizes of the opening between the curved jaw 93 and the toothed portion 92 (the positioning pin 951 is correspondingly located in either the first slot 911A or a second slot 911B), and only at most three nut sizes can be applied for the conventional wrench. Therefore, the conventional wrench has a drawback of low applicability.

Accordingly, it is necessary to invent improved new products to overcome the above-mentioned shortcomings and problems.

SUMMARY

An object of the present invention is to provide an adjustable wrench having advantages and effects of fast and simple adjustment and a lever arm thereof being adjustable for labor saving, etc. The present invention can solve drawbacks of low applicability of conventional wrenches.

To solve the above the above mentioned problems, the present invention provides an adjustable wrench comprising the following.

A handle part comprises a first pivotal portion, a second pivotal portion and a toothed portion. The toothed portion is formed at one end of the handle part, and the first pivotal portion is installed adjacent to the toothed portion.

A curved jaw part comprises an inner toothed portion, a linkage pivot portion, a jaw pivot portion and a planar portion. The jaw pivot portion and the planar portion are respectively formed at two opposite ends of the curved jaw part. The jaw pivot portion is pivotally connected to the first pivotal portion so as to enable the curved jaw part to rotate by a predetermined angle with respect to the first pivotal portion and to at least reach a first position thereof and a second position thereof.

A linkage part is connected to the linkage pivot portion at an end thereof. Additionally, the linkage part comprises a reacting portion.

An adjusting element comprises a plucking portion, an element interlinking portion, and an adjusting pivot portion. The element interlinking portion is used to engage with and move the reacting portion of the linkage part. The adjusting pivot portion is pivotally connected to the second pivotal portion so as to enable the adjusting element to rotate by a predetermined angle and allow the plucking portion to at least reach a third position thereof and a fourth position thereof.

A restoring element connects the handle part and the curved jaw part to enable the curved jaw part to remain in the first position thereof while no external force is applied thereon.

In this manner, when the plucking portion is pushed by an external force to move from the third position thereof to the fourth position thereof, the element interlinking portion is simultaneously moved to push the reacting portion of the linkage part so as to enable the linkage part to pull the curved jaw part moving from the first position thereof to the second position thereof. When the external force is withdrawn, the restoring element enables the curved jaw part to restore back to the first position thereof. Meanwhile, the element interlinking portion is simultaneously moved by the reacting portion of the linkage part so as to cause the plucking portion moving from the fourth position thereof to the third position thereof.

The objects and advantages of the present invention are further described in detail for better understanding in cooperation with accompanying drawings and embodiments as follows.

DETAILED DESCRIPTION OF THE EMBODIMENTS

Figure 1:
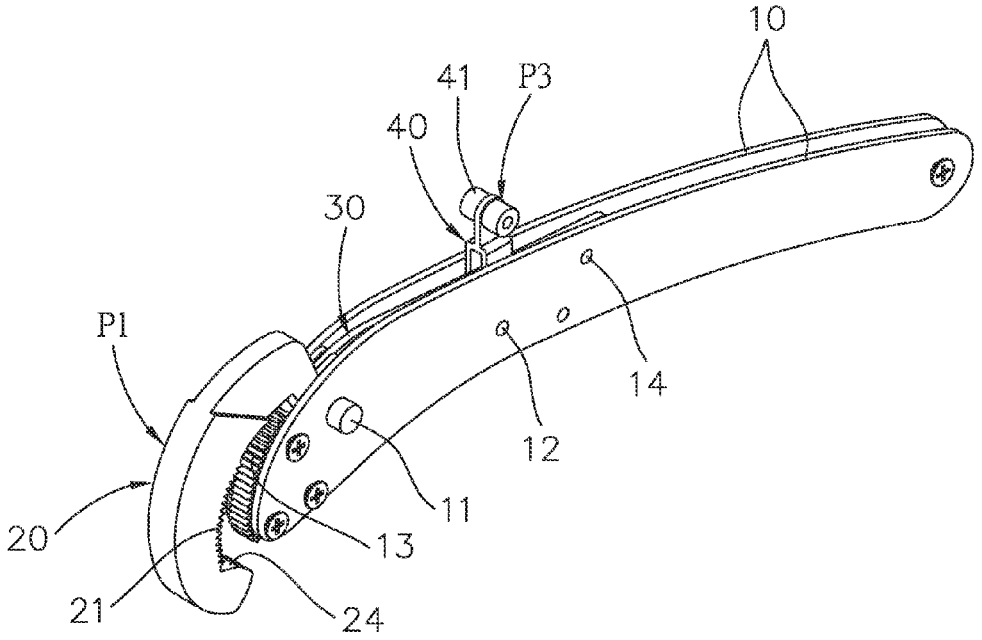
FIG. 1 is an assembled schematic perspective view of an adjustable wrench of the present invention.

Referring to FIG. 1, an adjustable wrench is provided in accordance with a first embodiment of the present invention. The adjustable wrench comprises a handle part 10, a curved jaw part 20, a linkage part 30, an adjusting element 40 and a restoring element 50.

Figure 2:
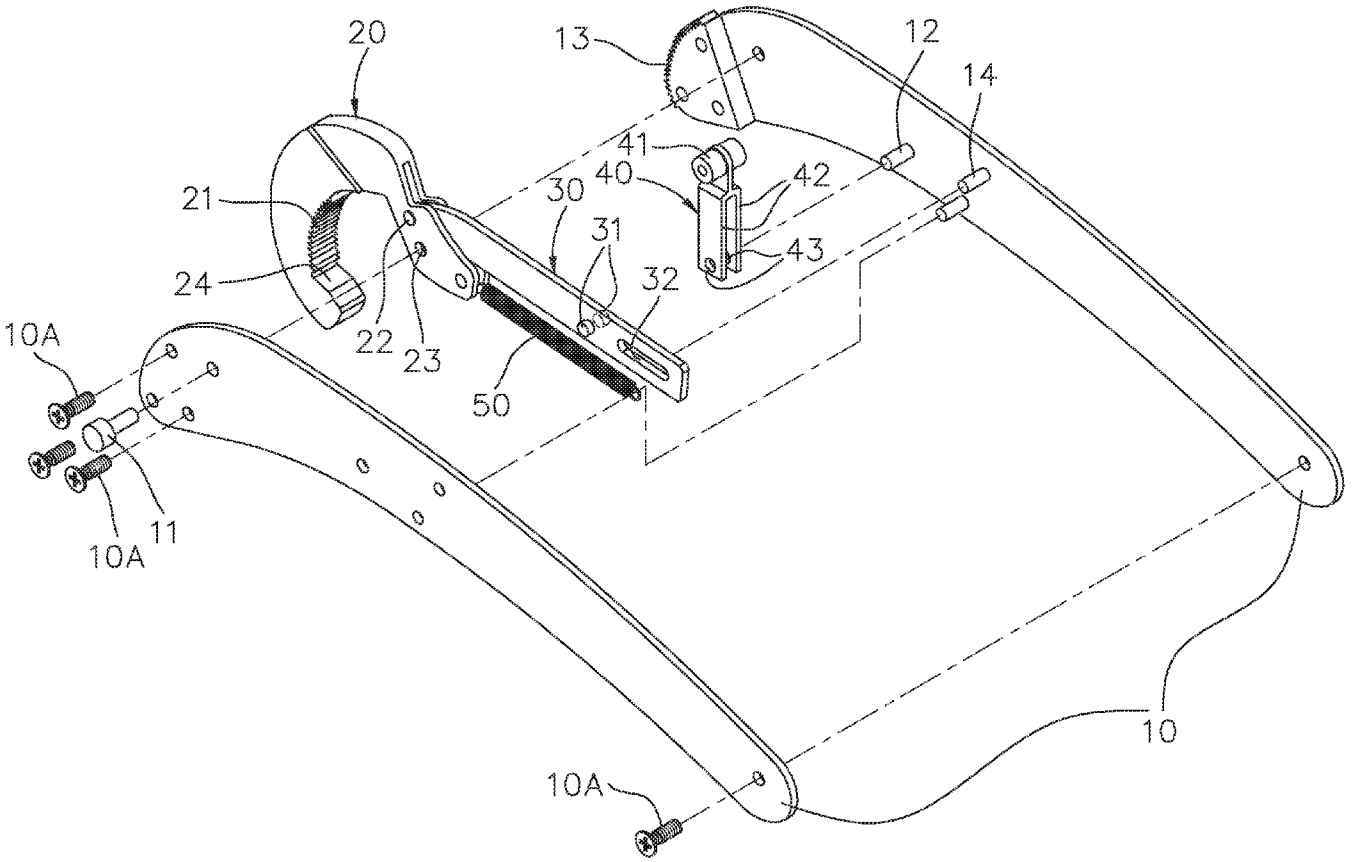
FIG. 2 is a schematic partially exploded perspective view of FIG. 1.

The handle part 10 defines a first pivotal portion 11, a second pivotal portion 12, and a toothed portion 13. The toothed portion 13 is formed at one end of the handle part 10, and the first pivotal portion 11 is installed adjacent to the toothed portion 13. As shown in FIG. 2, the handle part 10 of the first embodiment of the present invention is formed by two sheet bodies. The two sheet bodies are secured and installed together by threaded fixing of a plurality of fixing elements 10A (Certainly, the handle portion 10 can be designed as an integrally formed structure except for the above mentioned assembled design).

The curved jaw part 20 defines an inner toothed portion 21, a linkage pivot portion 22, a jaw pivot portion 23, and a planar portion 24. The jaw pivot portion 23 and the planar portion 24 are respectively formed at two opposite ends of the curved jaw part 20. The jaw pivot portion 23 is pivotally connected to the first pivotal portion 11 so as to enable the curved jaw part 20 to rotate by a predetermined angle with respect to the first pivotal portion 11 and to at least reach a first position P1 thereof and a second position P2 thereof.

The linkage part 30 is connected to the linkage pivot portion 22 at an end thereof. Additionally, the linkage part 30 comprises a reacting portion 31.

The adjusting element 40 comprises a plucking portion 41, an element interlinking portion 42, and an adjusting pivot portion 43. The element interlinking portion 42 is used to engage with and move the reacting portion 31 of the linkage part 30. The adjusting pivot portion 43 is pivotally connected to the second pivotal portion 12 so as to enable the adjusting element 40 to rotate by a predetermined angle and allow the plucking portion 41 to at least reach a third position P3 thereof and a fourth position P4 thereof.

The restoring element 50 connects the handle part 10 and the curved jaw part 20 to enable the curved jaw part 20 to remain in the first position P1 thereof while no external force is applied thereon.

In this manner, when the plucking portion 41 is pushed by an external force to move from the third position P3 thereof to the fourth position P4 thereof, the element interlinking portion 42 is simultaneously moved to push the reacting portion 31 of the linkage part 30 so as to enable the linkage part 30 to pull the curved jaw part 20 moving from the first position P1 thereof to the second position P2 thereof. When the external force is withdrawn, the restoring element 50 enables the curved jaw part 20 to restore back to the first position P1 thereof. Meanwhile, the element interlinking portion 42 is simultaneously moved by the reacting portion 31 of the linkage part 30 so as to cause the plucking portion 41 moving from the fourth position P4 thereof to the third position P3 thereof.

Figure 3:
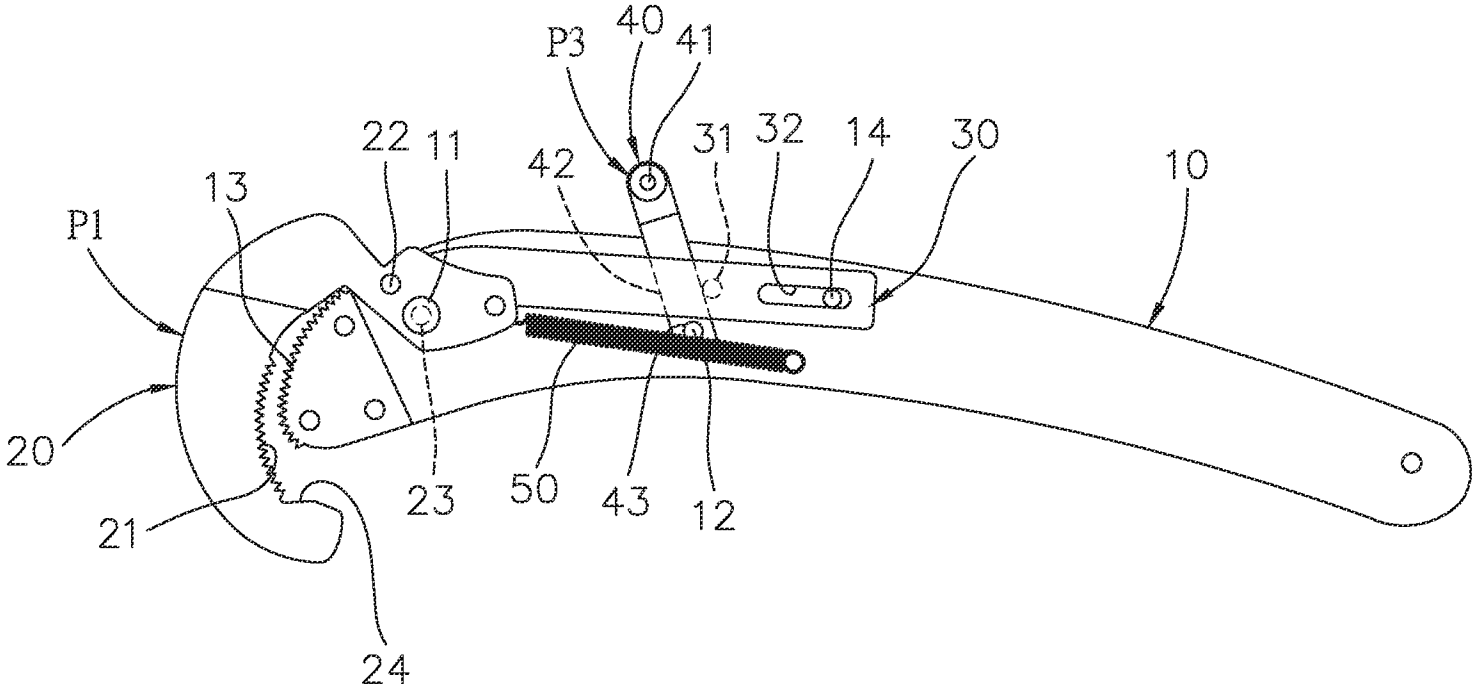
FIG. 3 is a schematic side view of FIG. 1 with a sheet body of the adjustable wrench of the present invention being removed, and showing the adjustable wrench of the present invention in a first adjustment motion thereof.
Figure 4:
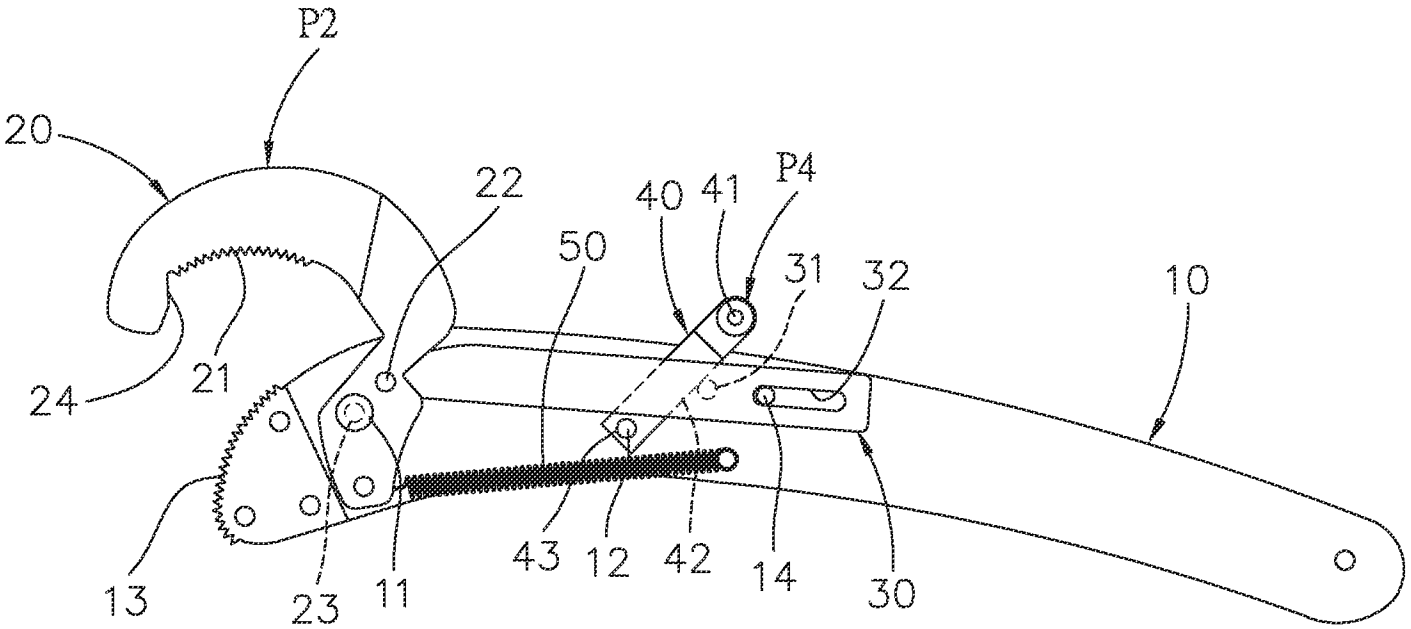
FIG. 4 is a schematic side view of FIG. 1 with the sheet body of the adjustable wrench of the present invention being removed, and showing the adjustable wrench of the present invention in a second adjustment motion thereof.

As shown in FIG. 3, the curved jaw part 20 is in the first position P1 thereof, and abuts upon and engages with the toothed portion 13 when the plucking portion 41 is in the third position P3 thereof. As shown in FIG. 4, when the plucking portion 41 is in the fourth position P4 thereof, the curved jaw part 20 is correspondingly in the second position P2 thereof and an opening is formed between the toothed portion 13 and the curved jaw part 20.

Specifically in details, when the curved jaw part 20 restores from the second position P2 thereof back to the first position P1 thereof, the linkage part 30 is pulled simultaneously by the curved jaw part 20, and the reacting portion 31 of the linkage part 30 moves to push the element interlinking portion 42 of the adjusting element 40 to further cause the plucking portion 41 moving from the fourth position P4 thereof to the third position P3 thereof.

In the first embodiment of the present invention, the element interlinking portion 42 is defined as a middle section of the adjusting element 40. When the adjusting element 40 rotates about the second pivotal portion 12 to enable the plucking portion 41 to move from the third position P3 to the fourth position P4, the element interlinking portion 42 engages with the reacting portion 31 of the linkage part 30 and pushes the reacting portion 31 so as to move the linkage part 30 and cause the curved jaw part 20 being pushed to rotate about the first pivotal portion 11 by a required opening angle.

Figure 5:
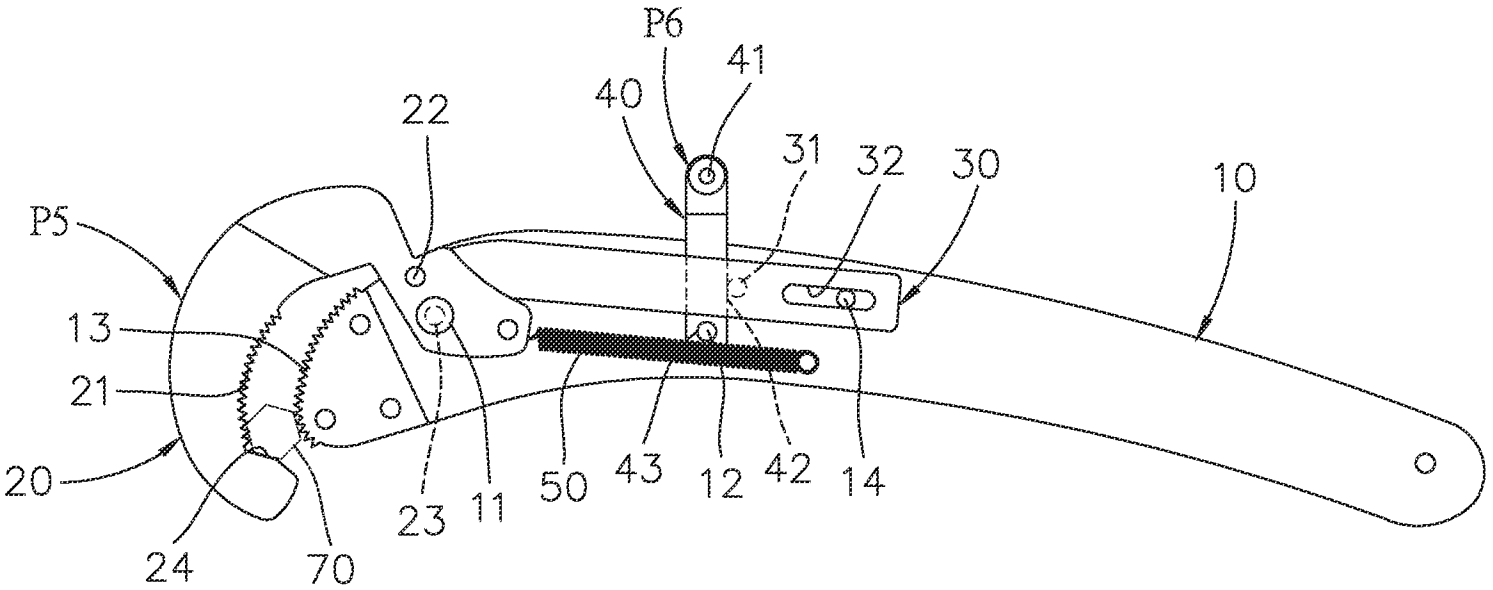
FIG. 5 is a schematic side view of FIG. 1 with the sheet body of the adjustable wrench of the present invention being removed, and showing the adjustable wrench of the present invention in a third adjustment motion thereof.

Certainly, except for the third position P3 and the fourth position P4, the plucking portion 41 is capable of being located at any locations between the third position P3 and the fourth position P4 so as to adjust a size of the opening defined between the curved jaw part 20 and the toothed portion 13. As shown in FIG. 5, the plucking portion 41 is plucked to a sixth position P6 located between the third position P3 and the fourth position P4 so as to cause the curved jaw part 20 simultaneously moving to a fifth position P5 (located between the first position P1 and the second position P2).

When the adjustable wrench of the present invention is applied to nuts 70 of different sizes, users simply need to hold the handle part 10 of the adjustable wrench with one hand thereof and pluck the plucking portion 41 with fingers (such as their thumbs), and a required size of the opening between the curved jaw part 20 and the toothed portion 13 can be immediately adjusted. In this situation, a polygonal side of the nuts 70 is able to correspond to the planar portion 24 of the curved jaw part 20, and at least two exterior edges of the nuts 70 defined between the polygonal sides are able to respectively correspond to the inner tooth portion 21 of the curved jaw part 20 and the toothed portion 13 of the handle part 10.

In design, the handle part 10 further comprises a limit element 14. The linkage part 30 comprises a limit trough 32. The limit element 14 is slidably movable and insertedly installed in the limit trough 32 so as to restrict a moving range of the linkage part 30. As shown in FIG. 3, when the plucking portion 41 in the third position P3 thereof, a right ultimate end of the limit trough 32 engages with the limit element 14 so that the adjusting element 40 is unable to further rotate counterclockwise. As shown in FIG. 4, when the plucking portion 41 in the fourth position P4 thereof, a left ultimate end of the limit trough 32 engages with the limit element 14 so that the adjusting element 40 is unable to further rotate clockwise.

Figure 6A:
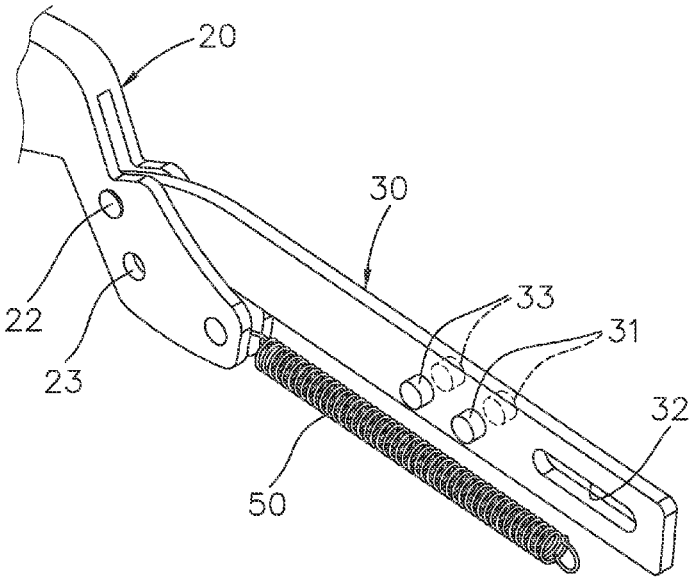
FIG. 6A is a schematic partial perspective view of a second embodiment of the adjustable wrench of the present invention.
Figure 6B:
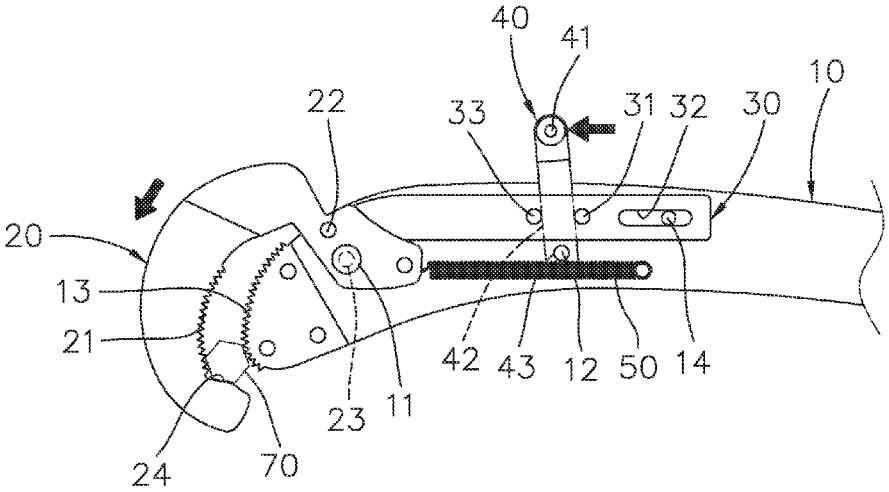
FIG. 6B is a schematic partial side view of FIG. 6A showing a moving relationship of the second embodiment of the adjustable wrench of the present invention.

As shown in FIG. 6A, in design, the linkage part 30 of the present invention also comprises a front reacting portion 33. As shown in FIG. 6B, when the plucking portion 41 is pushed toward the front reacting portion 33 (i.e., pushed toward the third position P3 thereof) by an external force, the front reacting portion 33 of the linkage part 30 is pushed by the element interlinking portion 42 simultaneously, and the linkage part 30 drives the curved jaw part 20 to rotate forward (i.e., rotate to the first position P1 thereof) in order to narrow the opening between the curved jaw part 20 and the toothed portion 13. In other words, when the opening between the curved jaw part 20 and the toothed portion 13 is too large to clamp the nuts 70 without loosing of the nuts 70, an action to push the plucking portion 41 toward the front reacting portion 33 can be made to adjust and narrow the opening for clamping the nuts 70 tightly.

Figure 7A:
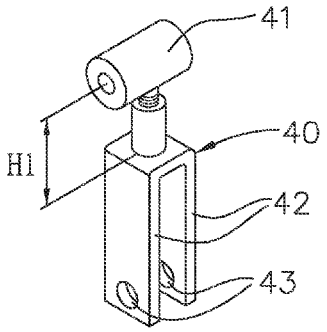
FIG. 7A is a schematic perspective view of a plucking portion of the adjustable wrench of the present invention in a first length adjustment thereof.
Figure 7B:
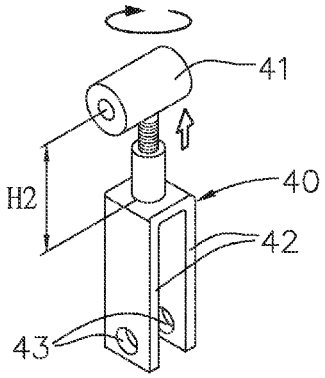
FIG. 7B is a schematic perspective view of the plucking portion of FIG. 7A in a second length adjustment thereof.
Figure 8A:
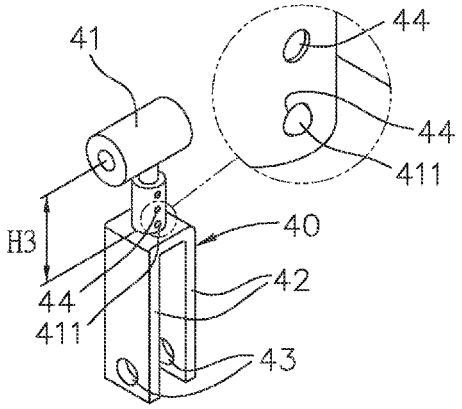
FIG. 8A is a schematic perspective view of another embodiment of the plucking portion of the adjustable wrench of the present invention in a first length adjustment thereof including an partial enlargement view of the plucking portion.
Figure 8B:
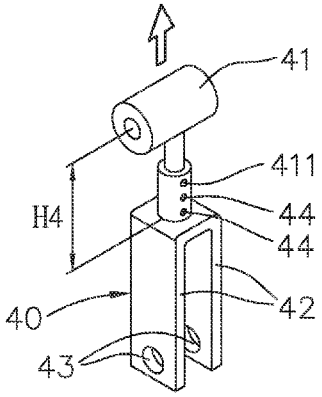
FIG. 8B is a schematic perspective view of the plucking portion of FIG. 8A in a second length adjustment thereof.
Figure 9:
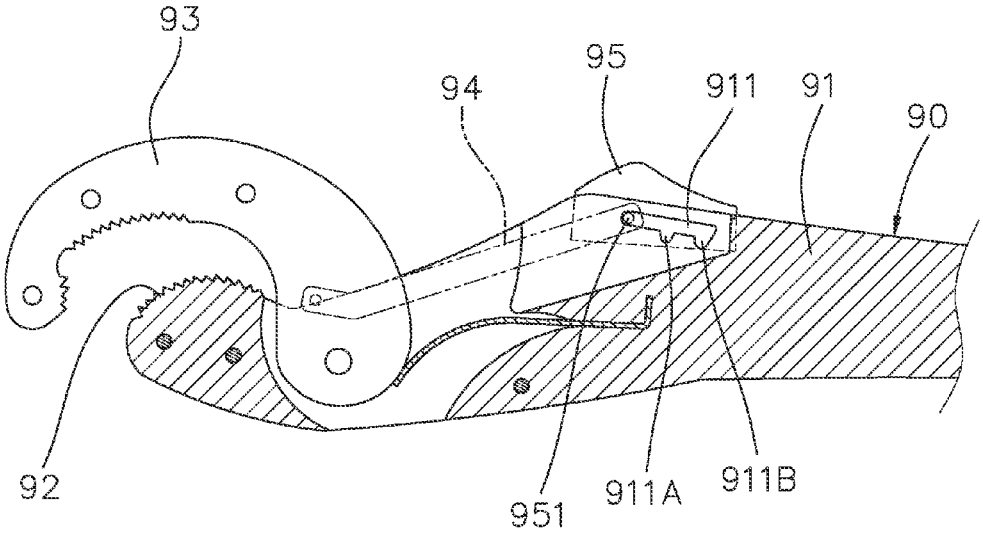
FIG. 9 (Prior Art)
FIG. 9 is a schematic partial sectional view showing a conventional wrench.

In addition, an extension length of the plucking portion 41 is adjustable. In design for adjusting, the plucking portion 41 can be designed as being adjustable by either screwing or engaging fitting. As shown in FIG. 7A, in the aspect of screwing adjustment, the plucking portion 41 is threadedly screwed on the adjusting element 40. When the plucking portion 41 is rotated, the plucking portion 41 can be adjusted to extend outwardly or retract back toward the adjusting element 40 according to the screwing directions (As shown in FIGS. 7A and 7B, a height of the plucking portion 41 extends from a first height H1 to a second height H2 after rotation of the plucking portion 41). As shown in FIG. 8A, in the aspect of engaging fitting, the plucking portion 41 comprises an engaging bulge 411 and the adjusting element 40 comprises a plurality of positioning holes 44. The engaging bulge 411 is used to engage within either one of the plurality of positioning holes 44. As a result, the plucking portion 41 can have different extending lengths by utilizing engagement between the fixing bulge 411 and either one of the plurality of positioning holes 44 in different positions, and the plucking portion 41 is adjustable due to such engagement to extend outwardly or retract back toward the adjusting element 40 based on work requirements (As shown in FIGS. 8A and 8B, a height of the plucking portion 41 extends from a third height H3 to a fourth height H4 after adjusting an engagement position of the fixing bulge 411 with one of the plurality of positioning holes 44).

Certainly, a distance between the plucking portion 41 and the second pivotal portion 12 increases due to length extension of the plucking portion 41. Therefore, a length of a lever arm which the distance between the plucking portion 41 and the second pivotal portion 12 stands for at the effort side of a lever extends, plucking actions to move the plucking portion 41 along the lever become much labor-saving.

To sum up, advantages and effects of the present invention can be concluded as following.

[1] Easy adjustment and high applicability: a drawback of adjusting design of conventional wrenches is low applicability because an opening formed between their corresponding curved jaws 93 and toothed portions 92 only has two sizes for adjustment. On the contrary, in the present invention, only action necessary is pushing the plucking portion 41 to adjust rotation angles of the adjusting element 40. As a result, the size of the opening between the curved jaw part 20 and the toothed portion 13 is accordingly adjusted to achieve best adjustment based on a size of a nut as required. Accordingly, the present invention has advantages of easy adjustment and high applicability.

[2] Adjustability of a lever arm for labor-saving: the present invention utilizes length adjustment of the plucking portion 41 to increase the distance between the plucking portion 41 and the second pivotal portion 12 so as to achieve an effect of length extension of the lever arm of a lever formed by the plucking portion 41 and the second pivotal portion 12. Accordingly, the present invention has advantages of labor-saving in actions of plucking the plucking portion 41.

The above mentioned is only exemplary embodiments of the present invention. As in detailed explanations as above, the present invention is proved to be understandable and the above mentioned inventive purpose is proved to be achievable by persons of ordinary skill in this art field. It should be noted, for persons of ordinary skill in this art field, improvements and modifications within the spirit of the present invention can be further made, and such improvements and modifications should be seemed to be included in the claimed scope of the present invention.

What is claimed is:

1. An adjustable wrench, comprising:

a handle part defining a first pivotal portion, a second pivotal portion, and a toothed portion, the toothed portion formed at one end of the handle part and the first pivotal portion installed adjacent to the toothed portion;

a curved jaw part defining an inner toothed portion, a linkage pivot portion, a jaw pivot portion, and a planar portion, the jaw pivot portion and the planar portion respectively formed at two opposite ends of the curved jaw part, the jaw pivot portion pivotally connected to the first pivotal portion so as to enable the curved jaw part to rotate by a predetermined angle with respect to the first pivotal portion and to at least reach a first position thereof and a second position thereof;

a linkage part connected to the linkage pivot portion at an end thereof, and comprising a reacting portion;

an adjusting element comprising a plucking portion, an element interlinking portion, and an adjusting pivot portion, the element interlinking portion being used to engage with and move the reacting portion of the linkage part, the adjusting pivot portion pivotally connected to the second pivotal portion so as to enable the adjusting element to rotate by a predetermined angle and allow the plucking portion to at least reach a third position thereof and a fourth position thereof; and a restoring element connecting the handle part and the curved jaw part so as to enable the curved jaw part to remain in the first position thereof while no external force is applied thereon;

wherein when the plucking portion is pushed by an external force to move from the third position thereof to the fourth position thereof, the element interlinking portion is simultaneously moved to push the reacting portion of the linkage part so as to enable the linkage part to pull the curved jaw part moving from the first position thereof to the second position thereof, and when the external force is withdrawn, the restoring element enables the curved jaw part to restore back to the first position thereof, the element interlinking portion is simultaneously moved by the reacting portion of the linkage part so as to cause the plucking portion moving from the fourth position thereof to the third position thereof; and wherein the plucking portion is threadedly installed on the adjusting element, an extending length of the plucking portion is adjustable through rotation of the plucking portion based on a rotation direction thereof.

2. The adjustable wrench as claimed in claim 1, wherein the handle part further comprises with a limit element, the linkage part further comprises a limit trough, the limit element is slidably movable and insertedly installed in the limit trough so as to restrict a moving range of the linkage part.

3. The adjustable wrench as claimed in claim 1, wherein the linkage part further comprises a front reacting portion, when the plucking portion is pushed toward the front reacting portion by an external force, the front reacting portion of the linkage part is pushed by the element interlinking portion simultaneously so as to move the linkage part toward the curved jaw part and further rotate the curved jaw part in order to narrow an opening between the curved jaw part and the toothed portion correspondingly.

4. An adjustable wrench, comprising:

a handle part defining a first pivotal portion, a second pivotal portion, and a toothed portion, the toothed portion formed at one end of the handle part and the first pivotal portion installed adjacent to the toothed portion;

a curved jaw part defining an inner toothed portion, a linkage pivot portion, a jaw pivot portion, and a planar portion, the jaw pivot portion and the planar portion respectively formed at two opposite ends of the curved jaw part, the jaw pivot portion pivotally connected to the first pivotal portion so as to enable the curved jaw part to rotate by a predetermined angle with respect to the first pivotal portion and to at least reach a first position thereof and a second position thereof;

a linkage part connected to the linkage pivot portion at an end thereof, and comprising a reacting portion;

an adjusting element comprising a plucking portion, an element interlinking portion, and an adjusting pivot portion, the element interlinking portion being used to engage with and move the reacting portion of the linkage part, the adjusting pivot portion pivotally connected to the second pivotal portion so as to enable the adjusting element to rotate by a predetermined angle and allow the plucking portion to at least reach a third position thereof and a fourth position thereof; and a restoring element connecting the handle part and the curved jaw part so as to enable the curved jaw part to remain in the first position thereof while no external force is applied thereon;

wherein when the plucking portion is pushed by an external force to move from the third position thereof to the fourth position thereof, the element interlinking portion is simultaneously moved to push the reacting portion of the linkage part so as to enable the linkage part to pull the curved jaw part moving from the first position thereof to the second position thereof, and when the external force is withdrawn, the restoring element enables the curved jaw part to restore back to the first position thereof, the element interlinking portion is simultaneously moved by the reacting portion of the linkage part so as to cause the plucking portion moving from the fourth position thereof to the third position thereof; and wherein the linkage part further comprises a front reacting portion, when the plucking portion is pushed toward the front reacting portion by an external force, the front reacting portion of the linkage part is pushed by the element interlinking portion simultaneously so as to move the linkage part toward the curved jaw part and further rotate the curved jaw part in order to narrow an opening between the curved jaw part and the toothed portion correspondingly.

* * * * *